United States Patent [19]

Piscionere, Sr.

[11] 3,936,134

[45] Feb. 3, 1976

[54] BATTERY CLAMP

[76] Inventor: Anthony G. Piscionere, Sr., 902 Kimball Ave., Bronxville, N.Y. 10708

[22] Filed: Oct. 4, 1973

[21] Appl. No.: 403,637

[52] U.S. Cl. ..... 339/235; 339/224

[51] Int. Cl. ..... H01r 11/26

[58] Field of Search ..... 339/224, 225, 228–231, 339/237, 238, 266, 263, 239, 240

[56] References Cited

UNITED STATES PATENTS

| | | | |
|---|---|---|---|
| 1,705,579 | 3/1929 | Lutz | 339/266 X |
| 1,877,830 | 9/1932 | Eyrick | 339/228 |
| 2,083,606 | 6/1937 | Johansson | 339/266 R |
| 3,397,382 | 8/1968 | Shannon | 339/230 R |
| 3,529,280 | 9/1970 | Best | 339/228 R |
| 3,694,798 | 9/1972 | Julian | 339/237 |
| 3,699,506 | 10/1972 | Hollins | 339/237 |
| 3,757,283 | 9/1973 | Kelly | 339/230 |
| 3,787,795 | 1/1974 | Thompson et al. | 339/263 R X |

*Primary Examiner*—Marion Parsons, Jr.
*Assistant Examiner*—Lawrence J. Staab
*Attorney, Agent, or Firm*—Jacob L. Kollin

[57] ABSTRACT

A clamp for securing a cable connector on a battery post to prevent the loosening of the cable connector. The clamp comprises a base formed with a perforation adapted to slide over a battery post. A pair of arms extend spacedly of said base. Means are provided for tightening the arms against the cable connector to secure it on a battery post.

2 Claims, 5 Drawing Figures

FIG. 1
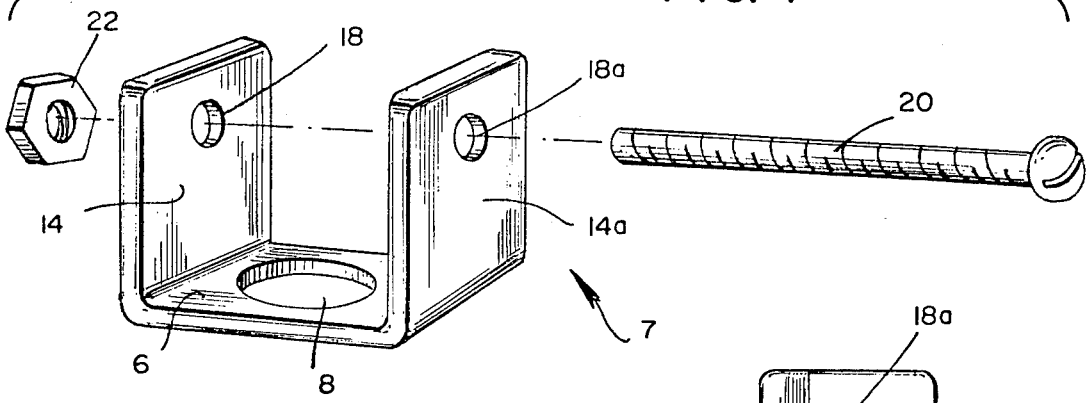
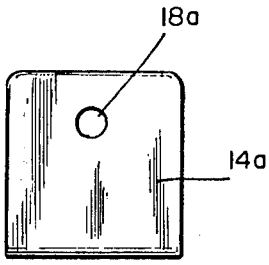
FIG. 3
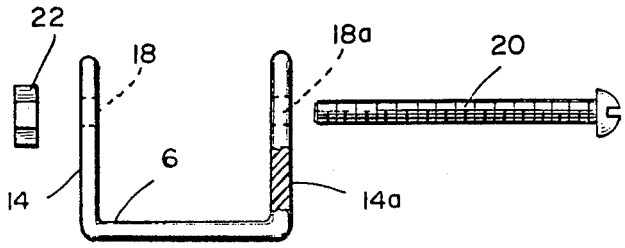
FIG. 2
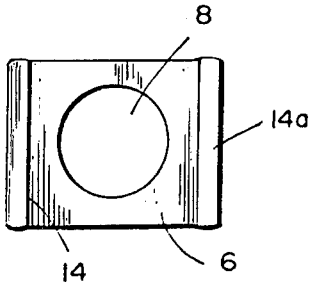
FIG. 4
FIG. 5
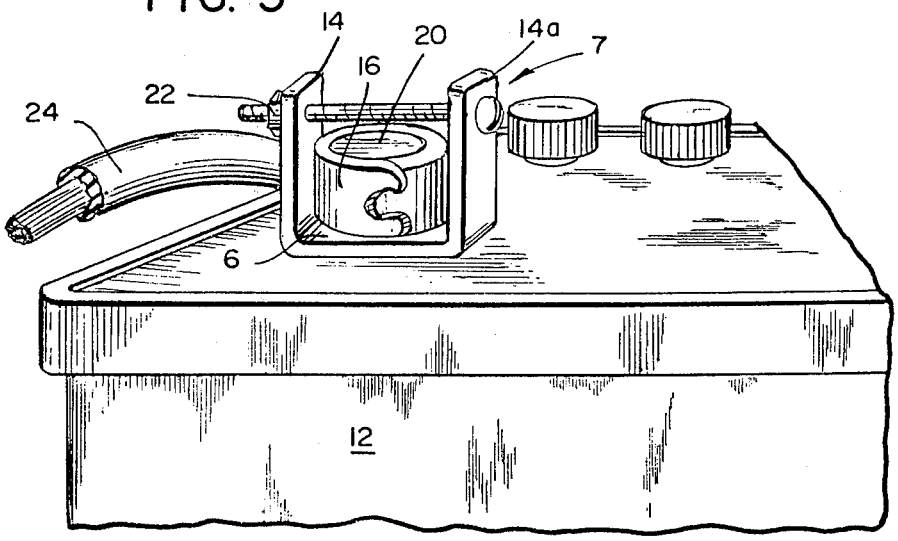

BATTERY CLAMP

The invention relates to cable connectors for storage batteries and particularly to means for firmly securing such cable connectors on battery post.

Cable connectors now universally used on storage battery posts in motor vehicles frequently loosen due to such causes as engine vibration, road shocks, oxidation of the connectors, etc.

The object of the invention is to provide a battery clamp which can be mounted on a battery post prior to attaching a cable connector proper, and which will tighten such connector in such a manner that it will not loosen from a battery post.

Another object of the invention is to provide a device of the above character, which is simple in construction and operation and requires no previous instruction in use.

These and other objects of the invention will become apparent from the following description in connection with the appended drawing illustrating a preferred embodiment of the invention. It is to be understood, however, that these are given by way of illustration and not of limitation and that changes may be made in the detail construction, form and size of the parts, without affecting the scope of the invention sought to be protected.

In the drawing:

FIG. 1 is an exploded view of the battery clamp,

FIG. 2 is a front elevation, exploded view, partly in section of the clamp,

FIG. 3 is a side view of the clamp,

FIG. 4 is a top plan view of the clamp and

FIG. 5 is a perspective view showing the clamp secured to a battery post.

Referring now to the drawing in detail, the battery clamp according to the invention generally indicated by the arrow 7 comprises a base 6 formed with a round aperture 8. The diameter of the aperture is such that the base 6 may be slopped over a positive or negative pole 10 of a battery 12. Formed integrally with the base 6 are a pair of vertical arms 14, 14*a*. The vertical arms are spaced sufficiently from one another to permit them to clear a battery cable clamp 16. The vertical legs 14, 14*a* are provided with a pair of aligned holes 18, 18*a*, through which may be passed a screw 20, to threadedly engage with a nut 22.

The battery clamp according to the invention is used as follows:

The base 6 of the battery clamp is slipped over the battery terminal 8. The cable clamp 16 of cable 24 is next secured to battery post 10, as shown in FIG. 5. Screw 20 is passed through holes 18, 18*a* and its threaded end engages with nut 22. The battery clamp legs 14, 14*a*, are made tight against the cable connector 16 by turning screw 20.

Having thus disclosed my invention, what I claim and desire to secure by Letters Patent of the United States of America is:

1. A battery clamp comprising, in combination, a cylindrical-shaped laterally constrictable clamping member of springy material for clamping about a battery smooth post extending, therethrough, a battery cable secured to an outer wall of said clamping member, a U-shaped member formed with a perforated base for receiving said battery post in engagement with said base, a pair of spaced constrictable arms extending upwardly of said base, said arms being spaced to clear said battery post and said clamping member, said clamping member being positioned between said arms, with the clamping member in alignment with the perforation in said base for receiving said battery post, and means for constricting said arms about said clamping member.

2. A battery clamp as claimed in claim 1, wherein said means for constricting said arms consist of a screw and nut, said arms having free ends provided with aligned holes, said screw extending through said holes.

* * * * *